US007517200B2

(12) United States Patent
Ferleyko et al.

(10) Patent No.: US 7,517,200 B2
(45) Date of Patent: Apr. 14, 2009

(54) VARIABLE DISCHARGE FUEL PUMP

(75) Inventors: Mandi R. Ferleyko, Metamora, IL (US); Scott A. Chockley, Washington, IL (US); Ronald D. Shinogle, Peoria, IL (US); Scott F. Shafer, Morton, IL (US); Jianhua Zhang, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 721 days.

(21) Appl. No.: 10/874,210

(22) Filed: Jun. 24, 2004

(65) Prior Publication Data

US 2005/0287021 A1 Dec. 29, 2005

(51) Int. Cl.
*F04B 43/12* (2006.01)
*F04B 49/06* (2006.01)

(52) U.S. Cl. ..... 417/53; 417/533; 417/454; 123/506

(58) Field of Classification Search ..... 417/417, 417/533, 531, 454, 53; 123/506
See application file for complete search history.

(56) References Cited

U.S. PATENT DOCUMENTS

| | | | | |
|---|---|---|---|---|
| 4,541,394 | A | 9/1985 | Schechter et al. | |
| 4,583,509 | A | 4/1986 | Schechter et al. | |
| 5,094,216 | A | 3/1992 | Miyaki et al. | |
| 5,133,645 | A | 7/1992 | Crowley et al. | |
| 6,224,350 | B1 | 5/2001 | Guentert et al. | |
| 7,179,060 | B2 * | 2/2007 | Sommars et al. | 123/506 |
| 2002/0053338 | A1 * | 5/2002 | Rembold et al. | 123/357 |
| 2004/0109768 | A1 * | 6/2004 | Sommars et al. | 417/307 |

FOREIGN PATENT DOCUMENTS

| | | |
|---|---|---|
| DE | 10036773 B4 | 2/2002 |
| EP | 0516916 | 12/1992 |
| EP | 1251272 | 10/2002 |
| EP | 1253313 | 10/2002 |
| EP | 1350948 | 10/2003 |

* cited by examiner

*Primary Examiner*—Charles G Freay
*Assistant Examiner*—Peter J Bertheaud
(74) *Attorney, Agent, or Firm*—Finnegan, Henderson, Farabow, Garrett & Dunner

(57) ABSTRACT

A pump has a housing defining at least one pumping chamber, and a plunger slidably disposed within the at least one pumping chamber. The plunger is movable between a first and second spaced apart end positions to pressurize a fluid. The pump also has a driver operatively engaged with the plunger to move the plunger between the first end position and the second end position. The pump further has a high-pressure outlet in fluid communication with the at least one pumping chamber. The high pressure outlet passes pressurized fluid during movement of the plunger between the first end position and the second end position. The passing of pressurized fluid through the high-pressure outlet terminates before the plunger completes movement from the first end position to the second end position.

6 Claims, 3 Drawing Sheets

VARIABLE DISCHARGE FUEL PUMP

DESCRIPTION

1. Technical Field

The present disclosure relates generally to a fuel pump, and more particularly to a variable discharge fuel pump.

2. Background

A variable discharge fuel pump is utilized to maintain a pressurized fuel supply for a plurality of fuel injectors in a common rail fuel system. For example, U.S. Pat. No. 5,094,216 (the '216 patent) to Miyaki et al. teaches a variable discharge high-pressure pump for use in a common rail fuel injection system. In such common rail systems, the pump supplies fuel to the common rail, which in turn supplies the fuel to the injectors when the injectors are energized. The pump serves to maintain the common rail at a desired pressure and does so by controllably displacing fuel from the pump to either a high-pressure common rail or toward a low-pressure reservoir with each pumping stroke of each pump piston. This is accomplished by associating an electronically controlled spill valve with each pump chamber. When the pump piston is undergoing its pumping stroke, the fuel displaced is initially pumped into a low-pressure reservoir past a spill control valve. When the spill control valve is energized, it closes the spill passageway causing fuel in the pumping chamber to quickly rise in pressure. The fuel in the pumping chamber is then pumped past a check valve into a high-pressure line connected to the common rail, and fuel is discharged into the fuel rail until the end of the pumping stroke.

However, because the pump of the '216 patent continues to discharge fuel into the fuel rail until the end of the pumping stroke, the pressure of the fuel discharged into the fuel rail may fluctuate undesirably. This fluctuation may occur due to, for example, the check valve remaining open during a portion of the downward motion of the plunger during an intake stroke, after completing the pumping stroke.

The disclosed fuel pump is directed to overcoming one or more of the problems set forth above.

SUMMARY OF THE INVENTION

In one aspect, the present disclosure is directed to a pump that includes a housing defining at least one pumping chamber and a plunger slidably disposed within the at least one pumping chamber. The plunger is movable between a first and second spaced apart end positions to pressurize a fluid. The pump also includes a driver operatively engaged with the plunger to move the plunger between the first end position and the second end position. The pump also has a high-pressure outlet in fluid communication with the at least one pumping chamber. The high-pressure outlet passes pressurized fluid during movement of the plunger between the first end position and second end position. The passing of pressurized fluid through the high-pressure outlet terminates before the plunger completes movement from the first end position to the second end position.

In another aspect, the present disclosure is directed to a method of operating a pump. The method includes moving a plunger from a second end position to a first end position to draw a fluid into the pumping chamber. The method also includes moving the plunger from the first end position to the second end position to pump the fluid through a spill passageway. The method additionally includes blocking the spill passageway to build pressure within the pumping chamber and passing the pressurized fluid through a high-pressure outlet during movement between the first end position and the second end position. The passing of pressurized fluid through the high-pressure outlet terminates before the plunger reaches the second end position.

DETAILED DESCRIPTION

Figure 1:
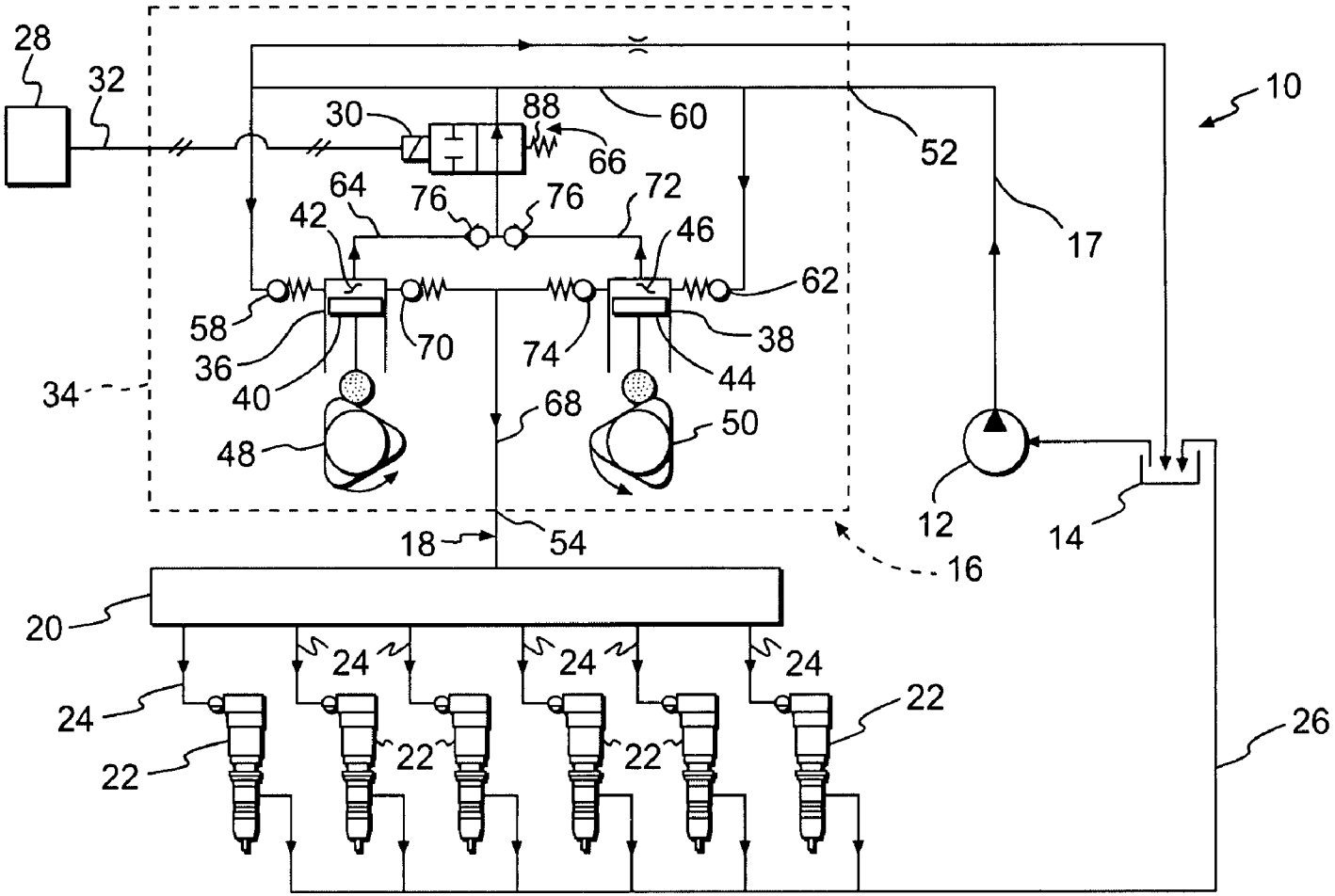
FIG. 1 is a schematic illustration of a common rail fuel system according to an exemplary embodiment of the present disclosure.

Referring to FIG. 1, a fuel system 10 includes a fuel transfer pump 12 that may transfer fuel from a low pressure reservoir 14 to a high-pressure pump 16 via a fluid passageway 17. High-pressure pump 16 may pressurize the fuel and direct the pressurized fuel through fluid passageway 18 to a fuel rail 20 that is in fluid communication with a plurality of fuel injectors 22 via fluid passageways 24. Fuel injectors 22 may be fluidly connected to reservoir 14 via a leak return passageway 26. An electronic control module 28 may be in communication with an actuator 30 connected to high-pressure pump 16 via a control communication line 32, and with individual fuel injectors 22 via additional communication lines (not shown).

High-pressure pump 16 may include a housing 34 defining a first and second barrel 36, 38. High-pressure pump 16 may also include a first plunger 40 slidably disposed within first barrel 36. First barrel 36 and first plunger 40 together may define a first pumping chamber 42. High-pressure pump 16 may also include a second plunger 44 slidably disposed within second barrel 38. Second barrel 38 and second plunger 44 together may define a second pumping chamber 46.

A first and second driver 48, 50 may be operably connected to first and second plungers 40, 44, respectively. First and second drivers 48, 50 may include any means for driving first and second plungers 40, 44 such as, for example, a cam, a solenoid actuator, a piezo actuator, a hydraulic actuator, a motor, or any other driving means known in the art. A rotation of first driver 48 may result in a corresponding reciprocation of first plunger 40 and a rotation of second driver 50 may result in a corresponding reciprocation of second plunger 44. First and second drivers 48, 50 may be positioned relative to each other such that first and second plungers 40, 44 are caused to reciprocate out of phase with one another. First and second drivers 48, 50 may each include three lobes such that one rotation of a pump shaft (not shown) connected to first and second drivers 48, 50 may result in six pumping strokes. Alternately, first and second drivers 48, 50 may include a different number of lobes rotated at a rate such that pumping activity is synchronized to fuel injection activity.

High-pressure pump 16 may include an inlet 52 fluidly connecting high-pressure pump 16 to fluid passageway 17. High-pressure pump 16 may also include a low-pressure gallery 60 in fluid communication with inlet 52 and in selective communication with first and second pumping chambers 42, 46. A first inlet check valve 58 may be disposed between low-pressure gallery 60 and first pumping chamber 42 and may be configured to allow a flow of low-pressure fluid from low-pressure gallery 60 to first pumping chamber 42. A second inlet check valve 62 may be disposed between low-pressure gallery 60 and second pumping chamber 46 and may be configured to allow a flow of low-pressure fluid from low-pressure gallery 60 to second pumping chamber 46.

High-pressure pump 16 may also include an outlet 54, fluidly connecting high-pressure pump 16 to fluid passageway 18. High-pressure pump 16 may include a high-pressure gallery 68 in selective fluid communication with first and second pumping chambers 42, 46 and outlet 54. A first outlet check valve 70 may be disposed between first pumping chamber 42 and high-pressure gallery 68 and may be configured to allow a flow of fluid from first pumping chamber 42 to high-pressure gallery 68. A second outlet check valve 74 may be disposed between second pumping chamber 46 and high pressure gallery 68 and may be configured to allow a flow of fluid from second pumping chamber 46 to high-pressure gallery 68.

High-pressure pump 16 may also includes a first spill passageway 64 selectively fluidly connecting first pumping chamber 42 to low-pressure gallery 60 and a second spill passageway 72 selectively fluidly connecting second pumping chamber 46 to low-pressure gallery 60. A spill control valve 66 may be disposed between first and second pumping chambers 42, 46 and low-pressure gallery 60 and may be configured to selectively allow a flow of fluid from first and second pumping chambers 42, 46 to low-pressure gallery 60.

Figure 2:
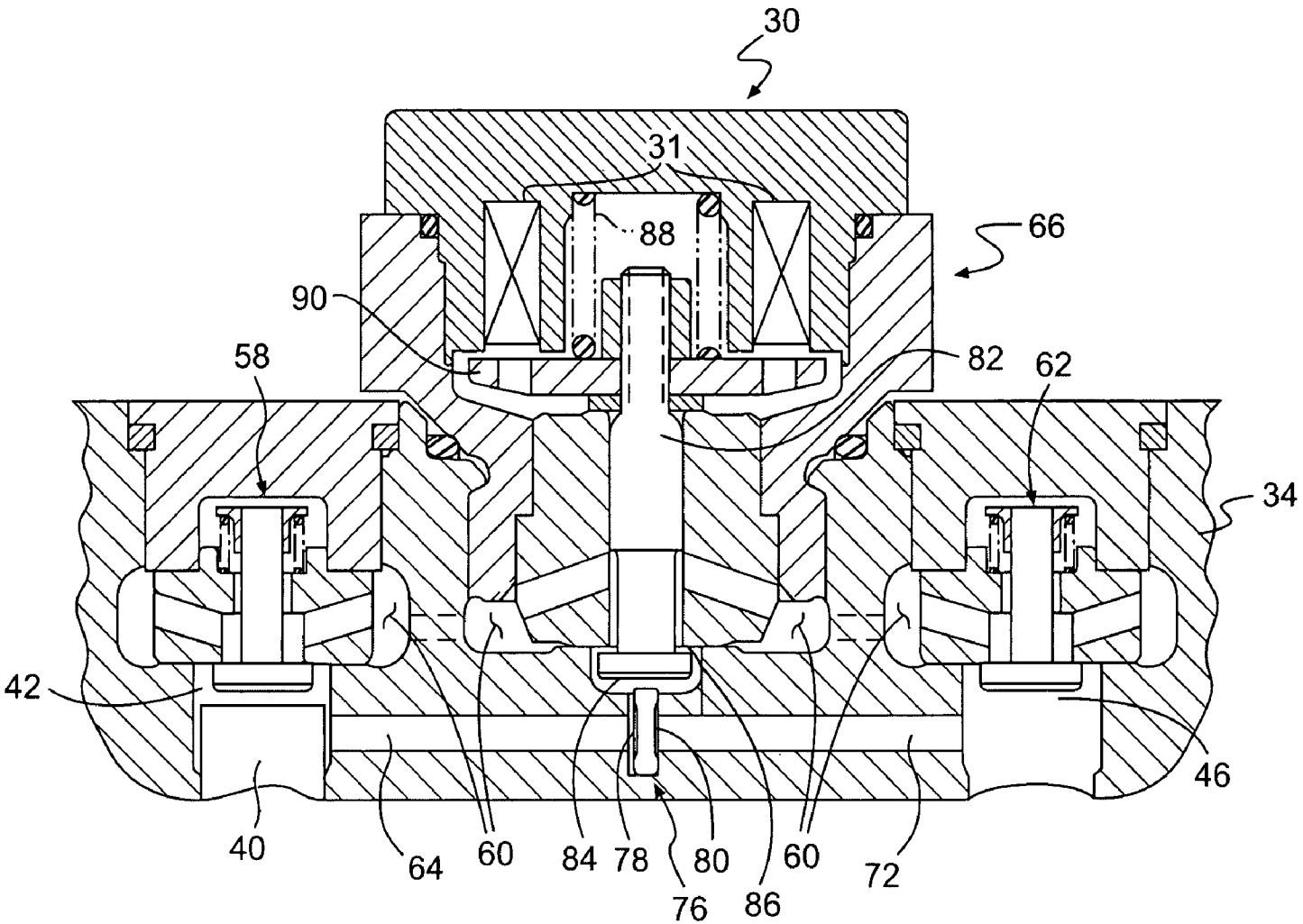
FIG. 2 is an enlarged cross-sectional view of a fill and spill portion of the pump of the system of FIG. 1.

Only one of first and second pumping chambers 42, 46 may be fluidly connected to low pressure gallery 60 at a time. As illustrated in FIG. 2, the fluid connection between pumping chambers 42, 46 and low pressure gallery 60 may be established by a shuttle valve member 76 that includes a first hydraulic surface 78 exposed to fluid pressure in first pumping chamber 42, and a second hydraulic surface 80, which is oriented in opposition to first hydraulic surface 78 and exposed to fluid pressure in second pumping chamber 46. Because first and second plungers 40, 44 may move out of phase relative to one another, one pumping chamber may be at high-pressure (pumping stroke) when the other pumping chamber is at low-pressure (intake stroke), and vice versa. This action may be exploited to move shuttle valve member 76 back and forth to fluidly connect either first spill passageway 64 to spill control valve 66, or second spill passageway 72 to spill control valve 66. Thus, first and second pumping chambers 42, 46 share a common spill control valve 66.

For example, when first plunger 40 moves through a pumping stroke and second plunger 44 moves through an intake stroke, shuttle valve member 76 may be in the position illustrated in FIG. 2, in which first pumping chamber 42 is fluidly connected to spill control valve 66. The fluid connection between first pumping chamber 42 and spill control valve 66 is created when fluid, pressurized by first pumping chamber 42 acting on first hydraulic surface 78, pushes shuttle valve member 76 to close second spill passageway 72 from spill control valve 66. In similar fashion, as second plunger 44 moves through the pumping stroke and first plunger 40 moves through the intake stroke, shuttle valve member 76 may move to connect second spill passageway 72 to spill control valve 66, while low-pressure fuel is drawn into first pumping chamber 42 past first inlet check valve 58.

Spill control valve 66 may include a spill valve member 82 having a hydraulic surface 84 that produces a latching affect when spill valve member 82 is in contact with a valve seat 86. Spill valve member 82 is normally biased towards a first position where fluid is allowed to flow past spill valve member 82, as shown in FIG. 2, via a biasing spring 88. Spill valve member 82 may also be moved to a second position where fluid is blocked from flowing past to spill valve member 82 by energizing actuator 30. Actuator 30 may include a solenoid 31 configured to attract an armature 90 coupled to spill valve member 82 when solenoid 31 is energized, thereby closing spill valve member 82. One skilled in the art will recognize that actuator 30 may be any type of actuator known in the art such as for example, a piezo and/or piezo bender actuator.

Control signals generated by electronic control module 28 directed to high-pressure pump 16 via communication line 32 may determine when and how much fuel is pumped into fuel rail 20. Control signals generated by electronic control module 28 directed to fuel injectors 22 may determine the actuation timing and actuation duration of fuel injectors 22.

Electronic control module 28 may include all the components required to perform the required system control such as, for example, a memory, a secondary storage device, and a processor, such as a central processing unit. One skilled in the art will appreciate that electronic control module 28 can contain additional or different components. Associated with electronic control module 28 may be various other known circuits such as, for example, power supply circuitry, signal conditioning circuitry, and solenoid driver circuitry, among others.

Figure 3:
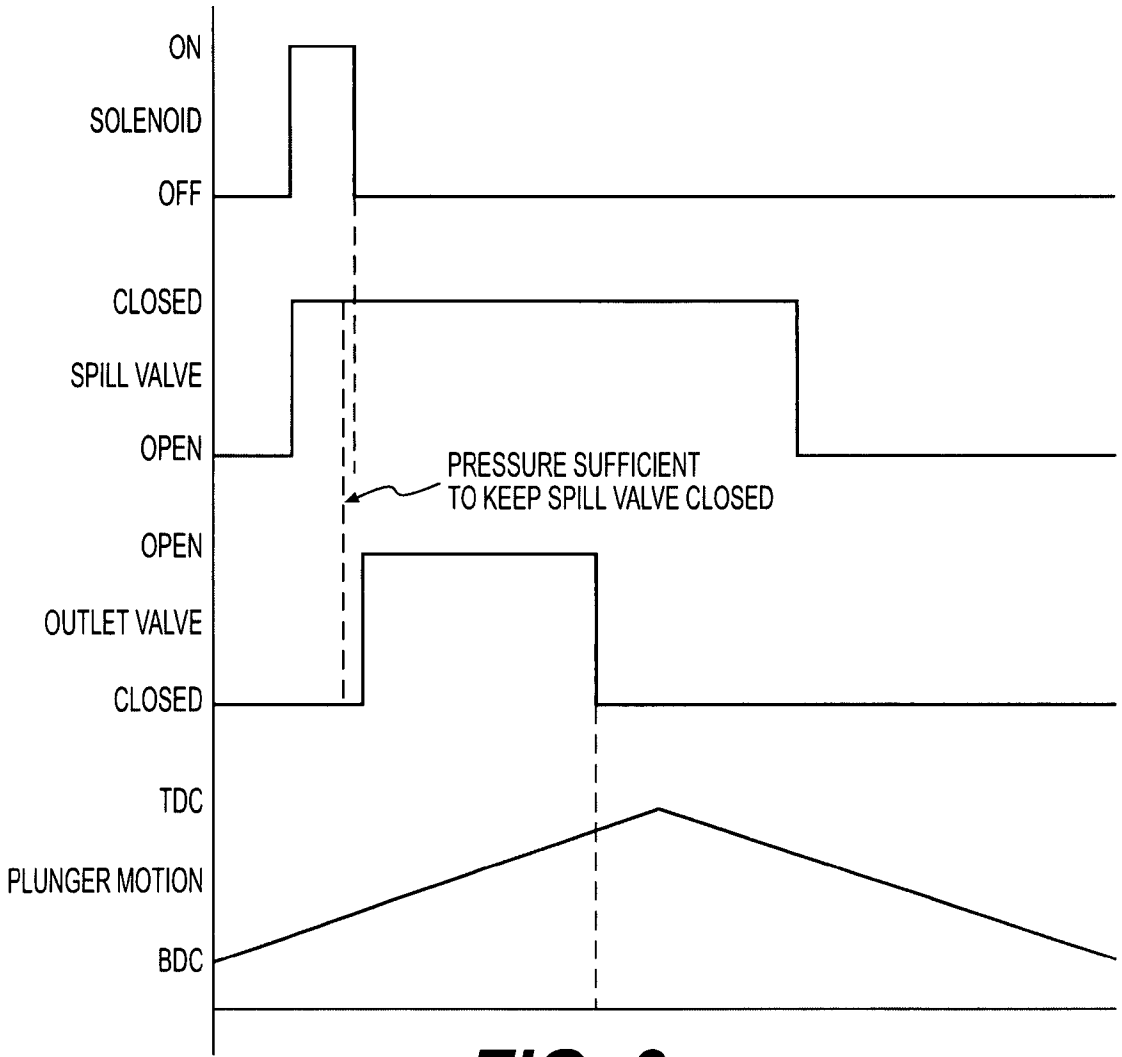
FIG. 3. is a graph showing solenoid actuation, spill valve actuation and outlet valve actuation relative to pump plunger movement according to the present disclosure.

FIG. 3 illustrates the relative operation of solenoid 31, spill control valve 66, and first and second outlet check valves 70, 74 relative to the motion of first and second plungers 40, 44. The operation of high-pressure pump 16, with respect to FIG. 3, will be described in the following section.

INDUSTRIAL APPLICABILITY

The disclosed pump finds potential application in any fluid system where it is desirous to control discharge from a pump. The disclosed pump finds particular applicability in fuel injection systems, especially common rail fuel injection systems. One skilled in the art will recognize that the disclosed pump could be utilized in relation to other fluid systems that may or may not be associated with an internal combustion engine. For example, the disclosed pump could be utilized in relation to fluid systems for internal combustion engines that use a hydraulic medium, such as engine lubricating oil. The fluid systems may be used to actuate various sub-systems such as, for example, hydraulically actuated fuel injectors or gas exchange valves used for engine braking. A pump according to the present disclosure could also be substituted for a pair of unit pumps in other fuel systems, including those that do not include a common rail.

Referring to FIG. 1, when fuel system 10 is in operation, first and second drivers 48, 50 rotate causing first and second plungers 40, 44 to reciprocate within respective first and second barrels 36, 38, out of phase with one another. When first plunger 40 moves through the intake stroke, second plunger 44 moves through the pumping stroke.

During the intake stroke of first plunger 40, fluid is drawn into first pumping chamber 42 via first inlet check valve 58. As first plunger 40 begins the pumping stroke, fluid pressure causes shuttle valve member 76 to allow displaced fluid to flow from first pumping chamber 42 through spill control valve 66 to low-pressure gallery 60. When it is desirous to output high-pressure fluid from high-pressure pump 16, solenoid 31 of actuator 30 may be energized to move spill valve member 82 toward solenoid 31 and close spill control valve 66.

As illustrated in FIG. 3, closing spill control valve 66 causes an immediate build up of pressure within first pumping chamber 42. After the pressure increases beyond a minimum threshold, solenoid 31 may be de-energized and the force generated by the build up of pressure against hydraulic surface 84 firmly holds spill control valve 66 in a closed position. As the pressure continues to increase within first pumping chamber 42, a pressure differential across first outlet check valve 70 produces an opening force on outlet check valve 70 that exceeds a spring closing force of outlet check valve 70. When the spring closing force of first outlet check valve 70 has been surpassed, first outlet check valve 70 opens and high-pressure fluid from within first pumping chamber 42 flows through first outlet check valve 70 into high-pressure gallery 68 and then into fuel rail 20 by way of fluid passageway 18.

One skilled in the art will appreciate that the timing at which actuator 30 is energized determines what fraction of the amount of fluid displaced by the first plunger 40 is pumped into the high-pressure gallery 68 and what is pumped back to low-pressure gallery 60. This operation serves as a means by which pressure can be maintained and controlled in fuel rail 20. As noted in the previous section, control of the energizing of actuator 30 is provided by signals received from electronic control module 28 over communication line 32.

Towards the end of the pumping stroke, as the angle of the portion of first driver 48 causing first plunger 40 to move decreases, the reciprocating speed of first plunger 40 proportionally decreases. As the reciprocating speed of plunger 40 decreases, the opening force caused by the pressure differential across first outlet check valve 70 nears and then falls below the spring force of first outlet check valve 70. First outlet check valve 70 moves to the closed position to block fluid through first outlet check valve 70 when the opening force caused by the pressure differential across first outlet check valve 70 falls below the spring force of first outlet check valve 70. The spring included in outlet check valve 70 has a spring constant selected to ensure that first outlet check valve 70 moves to block fluid from flowing through first outlet check valve 70 before the end of the pumping stroke. Because outlet check valve 70 moves to block fluid from flowing through outlet check valve 70 before the end of the pumping stroke, outlet check valve 70 will not be open during an intake stroke, thereby reducing the likelihood of pressure fluctuations within common rail 20. After outlet check valve 70 closes, first plunger 40 continues pressurizing the fluid within first pumping chamber 42 until the end of the pumping stroke. Pressure build up within first pumping chamber 42 after outlet check valve 70 closes may be accommodated by leakage from first pumping chamber 42 between first plunger 40 and first barrel 36, via compressibility of the fluid within first pumping chamber 42, and/or via mechanical strain within first pumping chamber 42.

After first plunger 40 completes the pumping stroke and begins moving in the opposite direction during the intake stroke, the pressure of the fluid within first pumping chamber 42 creates a force caused by the pressure differential across spill valve member 82 that nears and then falls below the force exerted by biasing spring 88. As the pressure differential across spill valve member 82 becomes less than the spring force of biasing spring 88, biasing spring 88 moves spill valve member 82 from solenoid 31 to the open position.

As second plunger 44 switches modes from filling to pumping (and first plunger 40 switches from pumping to filling), shuttle valve member 76 moves to the other side of its cavity blocking fluid flow from first pumping chamber 42 opening the path between pumping chamber 46 and spill control valve 66, thereby allowing spill control valve 66 to control the discharge of second pumping chamber 46. Second plunger 44 then completes a pumping stroke similar to that described above with respect to first plunger 40.

Several advantages are realized because the opening pressure of first and second outlet check valves 70, 74 is greater than the pressure required to hold spill valve member 82 in place. Spill valve member 82 may be held in place by fluid pressure while first and second outlet check valves 70, 74 are in the open position to allow fluid to flow through first and second outlet check valves 70, 74. Build-up of pressure within first and second pumping chambers 42, 46 is immediate, which allows for solenoid 31 of actuator 30 to be quickly de-energized, thereby reducing energy consumption and improving efficiency of the engine. In addition, the immediate build-up of pressure also facilitates hot-starting when the viscosity of the fluid is at a minimum. Further, because the discharge of pressure through first and second outlet check valves 70, 74 will stop before the end of the pumping stroke, pressure fluctuations in common rail 20 caused by pumping to the end of the stroke may be reduced and/or eliminated.

It will be apparent to those skilled in the art that various modifications and variations can be made to the pump of the present disclosure. Other embodiments of the pump will be apparent to those skilled in the art from consideration of the specification and practice of the invention disclosed herein. It is intended that the specification and examples be considered as exemplary only, with a true scope of the invention being indicated by the following claims and their equivalents.

What is claimed is:

1. A method of operating a pump, comprising:

moving a plunger within a pumping chamber from a second end position to a first end position to draw a fluid into the pumping chamber;

moving the plunger from the first end position to the second end position to pump the fluid through a spill passageway;

blocking the spill passageway to build pressure within the pumping chamber;

passing the pressurized fluid through a high-pressure outlet during movement between the first end position and the second end position, the passing of pressurized fluid through the high-pressure outlet terminating before the plunger reaches the second end position;

moving a spill valve member from a first spill valve position against a spring force to a second spill valve position and holding the spill valve member in the second spill valve position with fluid pressure to block the spill passageway;

holding the spill valve member in the second spill valve position with fluid pressure; and moving an outlet check valve from a second outlet check valve position against a spring force to a first outlet check valve position with fluid pressure to pass the pressurized fluid, wherein the spring force acting on the outlet check valve is greater than the spring force acting on the spill valve member.

2. The method of claim 1, wherein the plunger and pumping chamber are a first plunger and first pumping chamber and the method further includes:

moving a second plunger within a second pumping chamber between the first and second end positions out of phase with the first plunger; and moving a shuttle valve member between a first shuttle valve position and a second shuttle valve position to selectively fluidly connect the first pumping chamber and the second pumping chamber to the spill valve member.

3. A method of operating a pump, comprising:

moving a plunger within a pumping chamber from a second end position to a first end position to draw a fluid into the pumping chamber;

moving the plunger from the first end position to the second end position to pump the fluid through a spill passageway;

moving a spill valve member from a first spill valve position to a second spill valve position to block the spill passageway to build pressure within the pumping chamber;

holding the spill valve member in the second spill valve position with fluid pressure; and moving an outlet check valve from a second outlet check valve position to a first outlet check valve position with fluid pressure to discharge the pressurized fluid through a high-pressure outlet, the fluid pressure required to hold the spill valve member in the second spill valve position being less than the pressure required to move the outlet check valve from the second outlet check valve position.

4. The method of claim 3, wherein discharging of pressurized fluid through the high-pressure outlet has stopped before the plunger has completed movement from the first end position to the second end position.

5. The method of claim 3, wherein the plunger and pumping chamber are a first plunger and a first pumping chamber and the method further includes:

moving a second plunger within a second pumping chamber between the first and second end positions out of phase with the first plunger; and moving a shuffle valve member between a first shuttle valve position and a second shuffle valve position to selectively fluidly connect the first pumping chamber and the second pumping chamber with the spill valve member.

6. The method of claim 3, wherein moving the spill valve member from the first spill valve position to the second spill valve position is accomplished by energizing an actuator and the method further includes de-energizing the actuator after the pressure within the pumping chamber is sufficient to retain the spill valve member in the second spill valve position.

* * * * *